US006418652B1

(12) United States Patent
Crawford

(10) Patent No.: US 6,418,652 B1
(45) Date of Patent: Jul. 16, 2002

(54) DECORATIVE FRAME

(76) Inventor: Jean Crawford, 10 Enebro Rd., Sante Fe, NM (US) 87505

( * ) Notice: Subject to any disclaimer, the term of this patent is extended or adjusted under 35 U.S.C. 154(b) by 0 days.

(21) Appl. No.: 09/386,182

(22) Filed: Aug. 31, 1999

(51) Int. Cl.[7] ..... A47G 1/06
(52) U.S. Cl. ..... 40/798; 40/732
(58) Field of Search ..... 40/732, 779, 798, 40/799; 52/455; 312/245

(56) References Cited

U.S. PATENT DOCUMENTS

| | | | | | |
|---|---|---|---|---|---|
| 903,955 | A | * | 11/1908 | Carl et al. | 40/799 |
| 1,045,714 | A | * | 11/1912 | Liebert | 52/455 |
| 1,366,432 | A | * | 1/1921 | Summer | 40/779 X |
| 1,758,843 | A | * | 5/1930 | Lizotte | 312/245 X |
| 2,089,999 | A | * | 8/1937 | Greene | 312/245 |
| 2,223,674 | A | * | 12/1940 | Cohen | 40/799 |
| 2,538,386 | A | * | 1/1951 | Schneider | 40/798 |
| 2,654,451 | A | | 10/1953 | Schmidgall | |
| 2,814,895 | A | * | 12/1957 | Flam | 40/779 X |
| 3,216,678 | A | | 11/1965 | Foedisch | |
| 3,273,891 | A | | 9/1966 | Grim, Jr. | |
| 3,521,418 | A | | 7/1970 | Bartoloni | |
| 3,753,285 | A | * | 8/1973 | Gewertz | 40/799 X |
| 4,122,617 | A | | 10/1978 | Nielsen | |
| 4,158,274 | A | | 6/1979 | Saenz | |
| 4,200,359 | A | | 4/1980 | Lawson | |
| 4,311,363 | A | | 1/1982 | Marsalka et al. | |
| 4,320,164 | A | | 3/1982 | Nicolas et al. | |
| 4,516,341 | A | | 5/1985 | Jenkins | |
| 4,636,047 | A | | 1/1987 | Green | |
| 4,718,184 | A | | 1/1988 | Sherman | |
| 4,756,498 | A | | 7/1988 | Frye | |
| 4,850,125 | A | * | 7/1989 | Green | 40/799 X |
| 4,967,499 | A | * | 11/1990 | Rosenberg | 40/732 |
| 5,283,967 | A | * | 2/1994 | Abrams | 40/779 |
| 5,303,488 | A | * | 4/1994 | Todd et al. | 40/798 X |
| 5,367,803 | A | | 11/1994 | Albin | |

FOREIGN PATENT DOCUMENTS

| | | |
|---|---|---|
| GB | 2 094 535 A | 3/1982 |
| GB | 2 127 741 A | 7/1982 |

* cited by examiner

*Primary Examiner*—Jack Lavinder
*Assistant Examiner*—William L. Miller

(57) ABSTRACT

According to an example embodiment of the present invention, an extruded decorative frame member includes a front side opposite a back side, the front side having a substantially planar region and a retaining flange at each opposing edge of the substantially planar region. The front side is configured and arranged to accept and couple to decorative articles. The frame member further includes a first channel configured and arranged to provide mounting support and restraint in two dimensions relative to the front side.

28 Claims, 5 Drawing Sheets

DECORATIVE FRAME

FIELD OF THE INVENTION

The present invention relates generally to decorative picture and mirror frames and, more particularly, to decorative frames involving the application of decorative objects.

BACKGROUND OF THE INVENTION

Interior decoration for new designs and improvements to existing designs for homes and businesses is a strong and growing industry. As new designs and retrofits are created, the desire for customization in the industry is increasing. Individual home and business owners are striving to achieve unique designs for their applications, and are attempting to do so in a relatively cost-effective manner. In addition, many individuals are taking on the challenge of designing and decorating their own structures, rather than relying on professionals. These "do-it-yourself" individuals are looking for design improvements they can make and perform themselves without having to hire an expert.

Traditionally, typical applications for interior designs have been forced to rely upon standard commercially available components and designs for designing anew or retrofitting existing interior layouts. One of the reasons for this reliance upon standards stems from the push in manufacturing industries for high volume, low cost components, such as cabinets, trim, valances, doors, door frames, and other fixtures. Another reason for reliance upon a standard or a limited number of standards is the desire to maintain standard sizes and arrangements for the interchangeability of components, which also helps to keep costs low.

Although the use of standard components is generally cost efficient, it is not conducive to the customization of interior designs with colors, shapes, styles, and other design features. In addition, non-standard or custom-built components tend to be high in price, and therefore not feasible for use in many of today's applications. The overall lack of availability and affordability of components for interior design has been a hindrance to customization of interior designs.

SUMMARY OF THE INVENTION

The present invention is exemplified in a number of implementations and applications, some of which are summarized below. According to an example embodiment, the present invention is directed to an extruded decorative frame member adaptable for mounting decorative objects to the frame. The frame member comprises a front side having a substantially planar region and a retaining flange at each opposing edge of the substantially planar region. The front side is configured and arranged to accept and couple to decorative articles. The frame member further comprises a back side and a first channel configured and arranged to provide mounting support and to provide restraint in two dimensions relative to the front side.

In another example embodiment, a decorative frame assembly kit is provided. The kit includes a plurality of extruded frame members having a front side and a back side. The front side has a substantially planar region with retaining flanges at each opposing edge. The back side has a channel that provides restraint in two directions. Decorative tiles may be applied to the substantially planar region of the front side. Fasteners are provided for coupling the plurality of extruded frame members together via the channel. An apparatus is also provided for mounting at least one framing article to a frame member.

The above summary of the present invention is not intended to describe each illustrated embodiment or every implementation of the present invention. The figures and detailed description which follow more particularly exemplify these embodiments.

BRIEF DESCRIPTION OF THE DRAWINGS

The invention may be more completely understood in consideration of the following detailed description of various embodiments of the invention in connection with the accompanying drawings, in which.

Figure 1A:
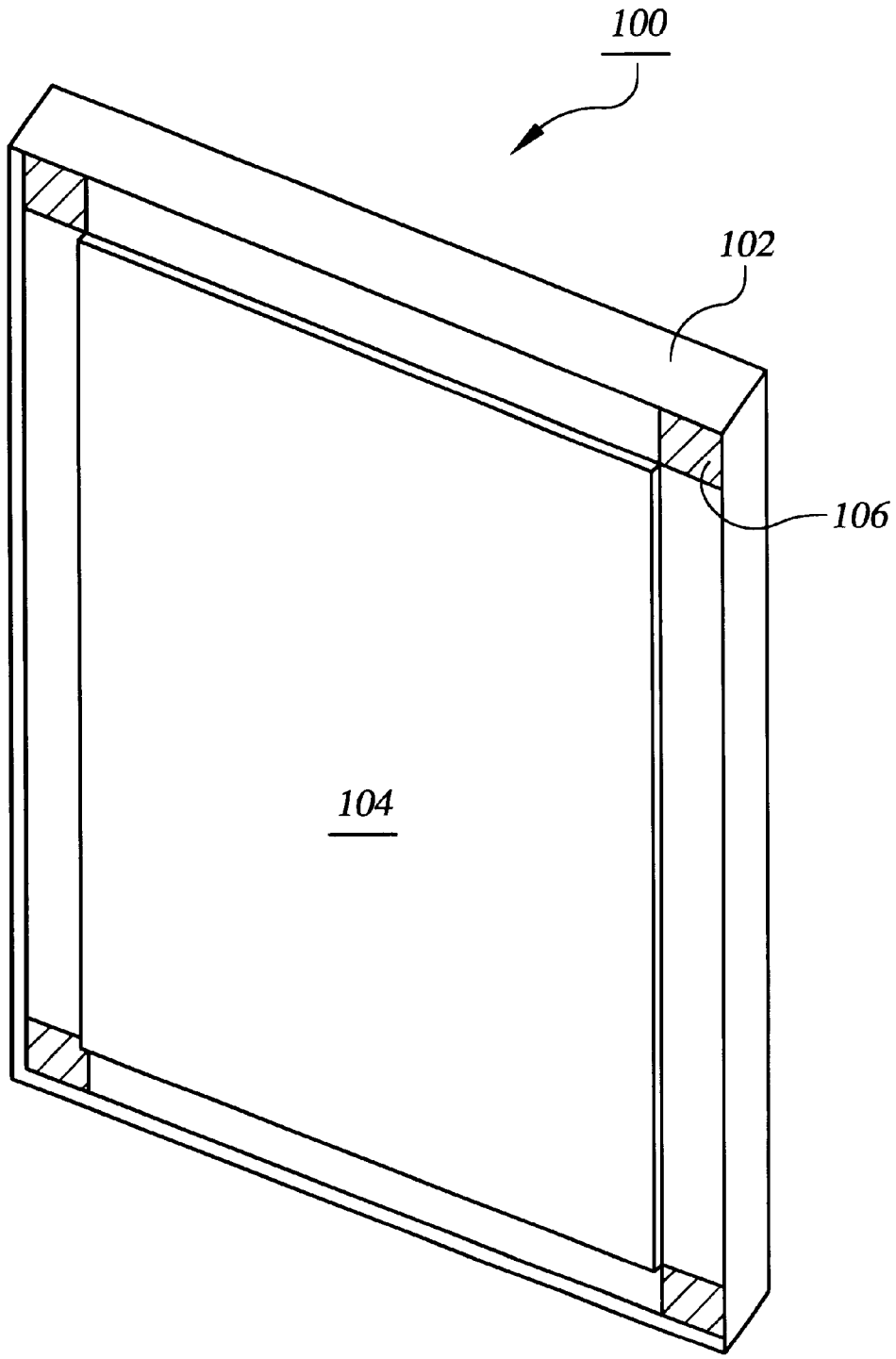
FIG. 1A shows a partial assembly for a frame comer junction, according to an example embodiment of the present invention.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION

The present invention is believed to be applicable to a variety of different types of frame applications, and the invention has been found to be particularly suited for applications requiring or benefiting from decorative frame attachments. While the present invention is not necessarily limited to such devices, various aspects of the invention may be appreciated through a discussion of various examples using this context.

One embodiment of the present invention is directed toward a frame member having the capacity to include decorative objects in a picture, mirror, valance, or other type of frame. According to an example embodiment, an extruded decorative frame member having a front side and a back side is provided. The frame member may include materials such as metal, plastic, and treatments or combinations thereof. For instance, using extruded or rolled aluminum as an example material, the aluminum can be used in raw extruded or rolled form, or be anodized, etched, painted, or coated. In addition, the frame member may be substantially straight or have curvature. The front side has a substantially planar region capable of receiving decorative articles and a retaining flange at each opposing edge of the substantially planar region. The frame member further includes at least one channel that provides restraint in at least two directions relative to the front side. Decorative objects can be readily attached to the substantially planar region, providing the opportunity to easily augment the decorative quality of frames.

The frame member can also be coupled with at least one other member and be made into a frame having at least one shape such as a polygon, a rectangle, a square, an arc, a circle, a triangle, a pentagon, or a combination of shapes. An apparatus for mounting framing articles such as glass, a mirror, a picture, a portrait, and a light valance can also be included in the frame. According to a more particular example embodiment of the present invention, a frame for use in conjunction with a light valance is configured and arranged to accept and couple to a light diffuser. The light diffuser can, for instance, be attached to the bottom flange of a frame member.

The frame member is also usable in a kit application, wherein a user assembles a plurality of frame members into an assembled decorative frame, such as shown in FIG. 1A. This allows the user to choose the type of decoration to add to the frame member, as well as to customize the frame shape to the type of article to be framed. The frame members can be fastened together via the channels using fastening members shaped to fit into the channels, such as available from Nielsen & Bainbridge, LLC, of Gainesboro, TN, and fasteners for coupling the fastening members to the channels, such as screws, bolts, and nuts.

FIG. 1A shows an assembled decorative frame 100, according to another example embodiment of the present invention. Four frame members 102 are coupled together and form a rectangular frame. A mirror 104 is shown coupled to the frame, and decorative tiles 106 are attached to the frame members in the comers of the frame. In a more particular example embodiment of the present invention, the decorative frame 100 is attached to a cabinet and forms a cabinet door.

Figure 1B:
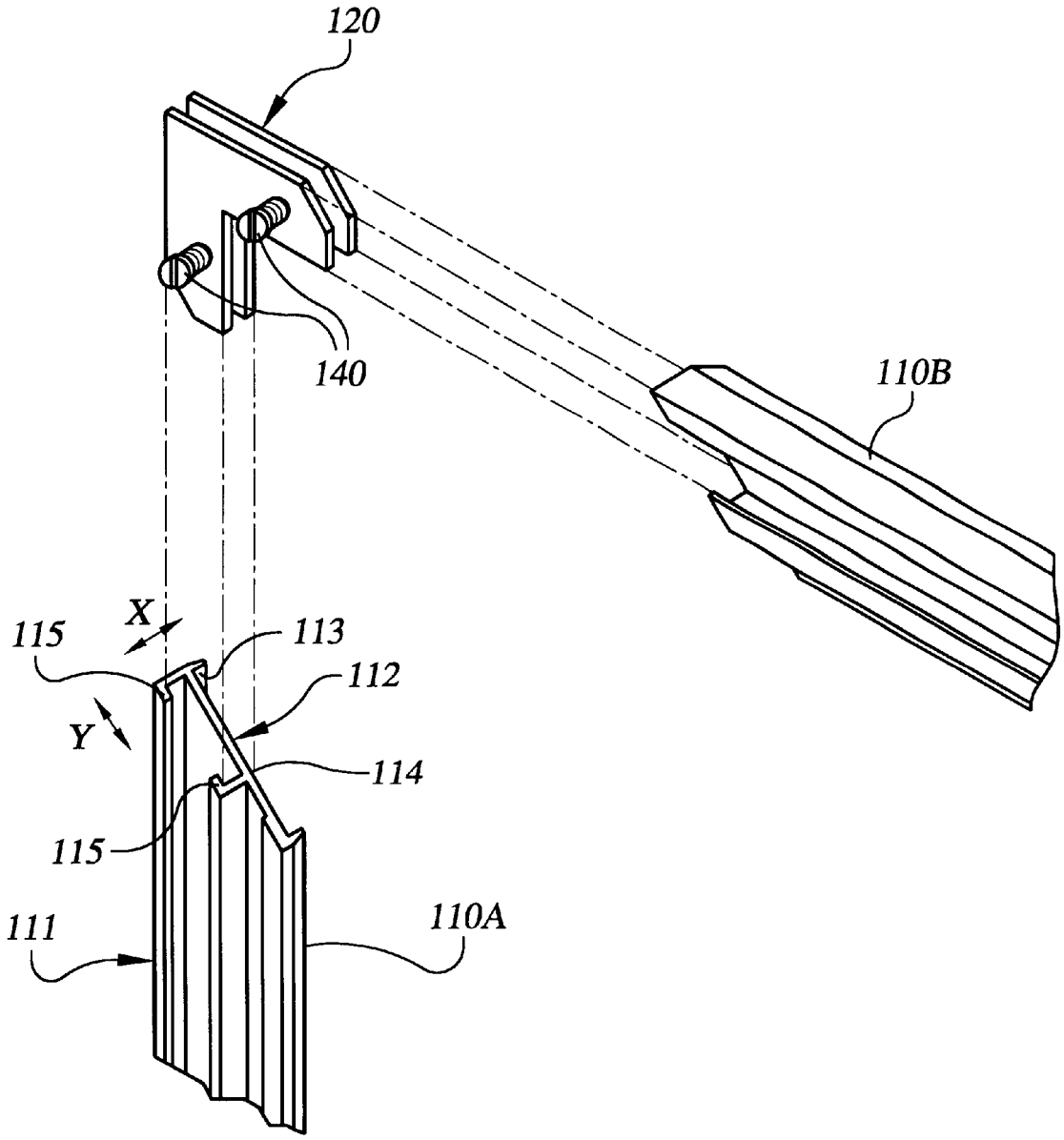
FIG. 1B shows an assembled decorative frame, according to another example embodiment of the present invention.

According to a specific example embodiment for a supporting frame, and referring to FIG. 1B, an extruded frame member 110A, having a front side 112 and a back side 111, is used as the main support member of a decorative frame, such as shown in FIG. 1A. The front side 112 has a substantially planar region 114 and a retaining flange 113 at each opposing edge of the substantially planar region 114. The substantially planar region 114 is capable of receiving decorative articles. The back side 111 includes a channel 115 that provides restraint in directions X and Y. Decorative objects can be readily attached to the substantially planar region 114.

According to another example embodiment, the frame member 110A is further coupled with a second frame member 110B via channel comer 120. Channel comer 120 fits into the channel 115, and is coupled to the channel 115 via fasteners 140. The ability to secure a fastener to the frame via a channel without marring, pitting, deforming, or otherwise damaging the aesthetic portion of the frame improves the usability of the frame. By securing to the channel in the back side of the frame, the hinge fastener does not contact directly the aesthetic outer portions of the frame, and the frame itself remains near its original condition. The frame members 110A and 110B may further be coupled to additional frame members and form a frame.

Figure 2:
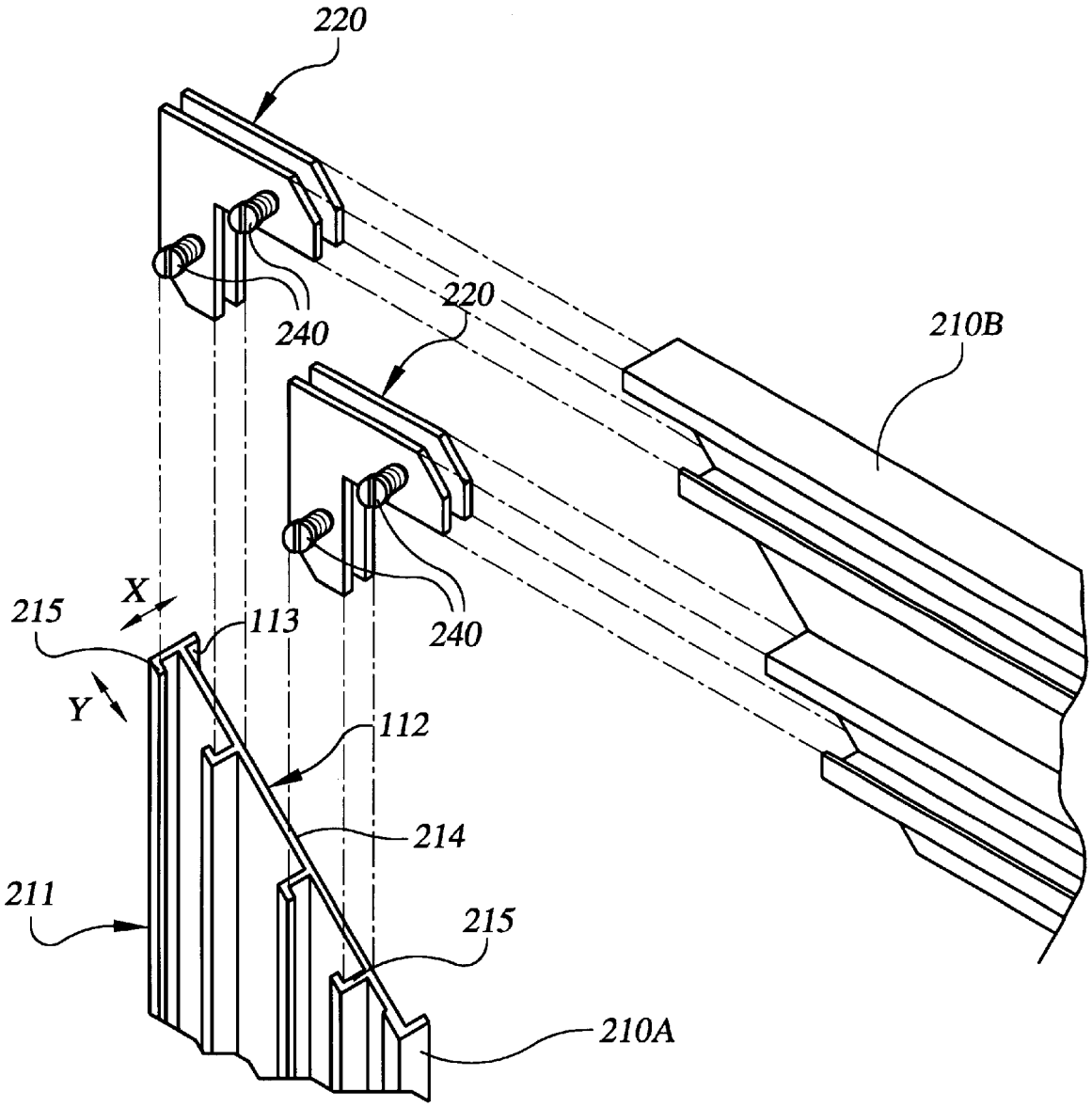
FIG. 2 shows a partial assembly for a frame comer junction, according to another example embodiment of the present invention.

According to another example embodiment, FIG. 2 shows a frame member 210A having a front side 212 and a back side 211. The front side 212 has a substantially planar region 214 and a retaining flange 213 at each opposing edge of the substantially planar region 214. The substantially planar region 214 is capable of receiving decorative articles. The back side 211 includes two channels 215 that provide restraint in directions X and Y. According to another example embodiment, the frame member 210A is further coupled with a second frame member 210B via apparatuses 220. Apparatuses 220 fit into the channels 215 and are coupled to the channels 215 via fasteners 240.

Figure 3:
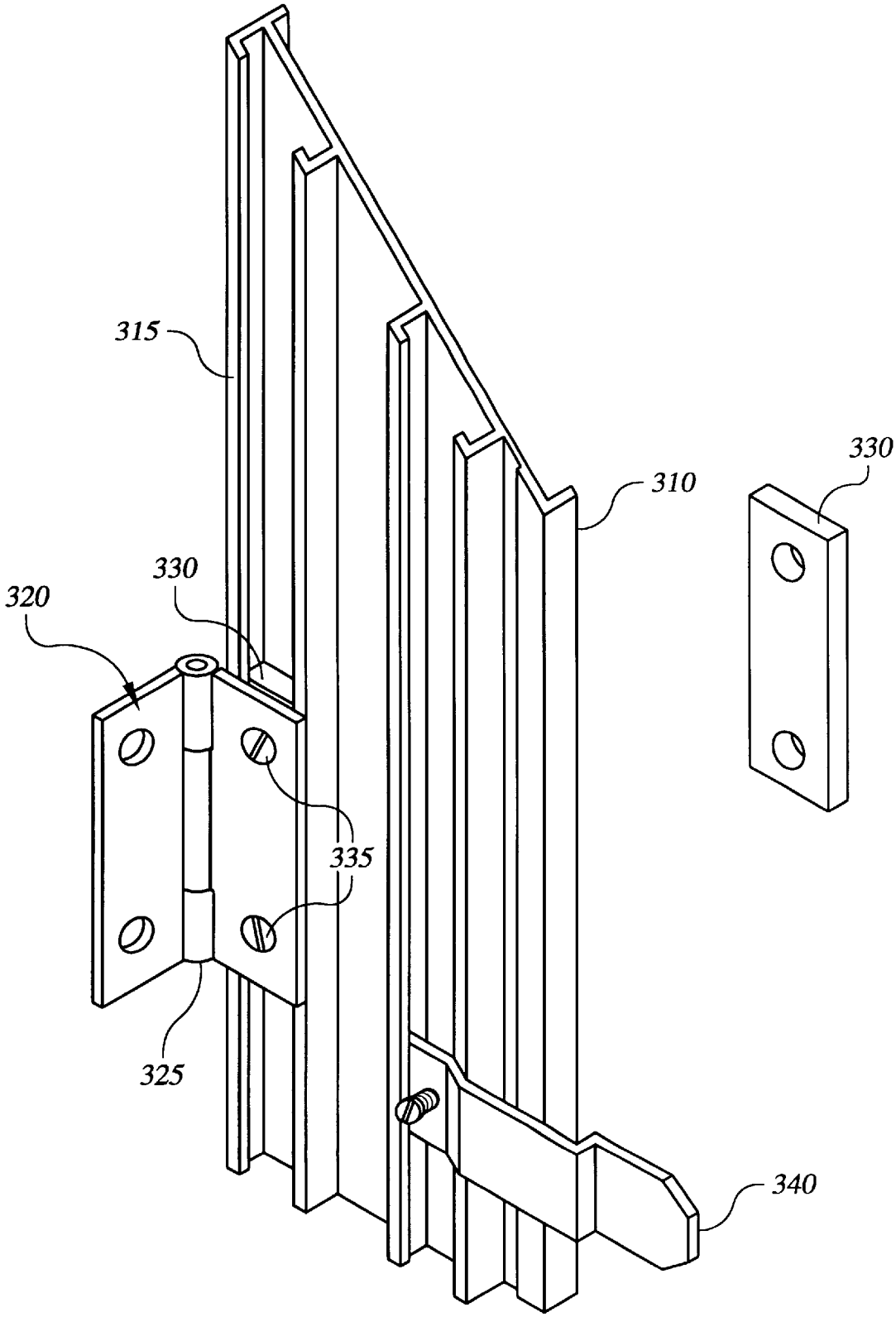
FIG. 3 shows a frame member, according to another example embodiment of the present invention.

According to another example embodiment and referring to FIG. 3, a hinge arrangement 320 includes a hinge nut plate 330 that fits into a channel 315 in the back side of a frame 310. A hinge member 325 is coupled to the hinge nut plate 330 via fasteners 335. The hinge apparatus 320 may then be mounted to a surface, such as a cabinet or a door frame. According to another aspect of this example embodiment, a mounting arrangement 340 is attached to the frame member 310 for mounting at least one framing article, such as a mirror, glass, or a picture to the frame member.

The hinge mounting apparatus provides an easy application of the invention to a variety of types of cabinet or door mounting configurations. This is particularly useful in situations where the frame is used as a replacement door in existing products, and can be sold in a kit form for user replacement of the door. The ease of adjusting the hinge fasteners to match various fastening arrangements makes the retro-fit of this type of door an uncomplicated process. In addition, the manufacturing costs for the present invention are reduced because the hinge fasteners are applicable to any frame having the same channel size and shape, regardless of its length or the number of hinges required. In a more particular example embodiment, the frame door is made with heavier objects, such as leaded glass, heavy tile, ceramics, stone, or other material. Additional hinges can be added and fastened to provide additional support for the door. When coupled with heavy objects, the heavier door provides the feel of a high quality cabinet door.

Figure 4:
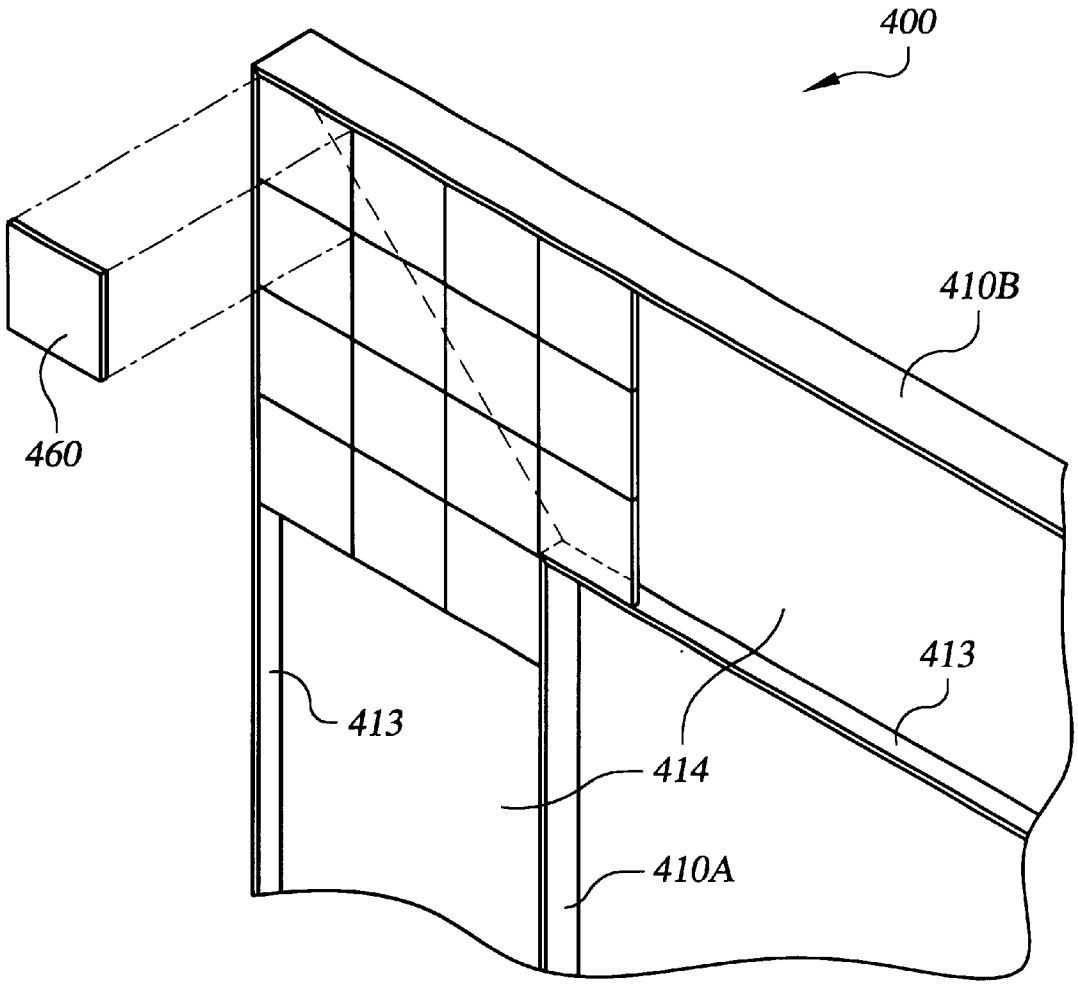
FIG. 4 shows partially-assembled frame members, according to another example embodiment of the present invention.

FIG. 4 shows decorative articles 460 mounted to frame members 410A and 410B, according to another example embodiment of the present invention. The decorative articles 460 are mounted on a substantially planar region 414 between flanges 413. The articles 460 may, for instance, be mounted to the frame using fasteners or an adhesive, such as cement, glue, tape, or other material. Although FIG. 4 shows rectangular articles being applied to the frame members, cylindrical, cubical, rectangular, and other differently-shaped articles may also be applied to the frame. In addition, the articles applied to the frame may comprise materials such as ceramic, glass, and holographic tiles including, for example, dichroic glass. Tiles are available from Bisazza S.p.A. of Alte, Italy. The decorative articles may also include heavy objects, such as leaded glass, stone, or other material. As discussed above in connection with FIG. 3, the use of heavy decorative articles adds weight and improves the feel of a decorative frame used in cabinet or door mounting configurations.

While the present invention has been described with reference to several particular example embodiments, those skilled in the art will recognize that many changes may be made thereto without departing from the spirit and scope of the present invention, which is set forth in the following claims.

What is claimed is:

1. A decorative frame member comprising:

at least one decorative tile article;

a front side having a substantially planar region and a retaining flange at each opposing edge of the substantially planar region, wherein the front side is configured and arranged to accept, couple to and substantially enclose said decorative tile article with a respective front surface exposed between the retaining flanges;

a back side opposite the front side; and a first channel configured and arranged to provide mounting support and to provide restraint in at least two dimensions relative to the front side.

2. A decorative frame member, according to claim 1, wherein the first channel provides restraint in a direction substantially perpendicular to the substantially planar region of the front side and in a direction substantially transverse to the flanges at the front side at a point adjacent the portion of the first channel that provides restraint.

3. A decorative frame member, according to claim 1, wherein the frame member is coupled to at least one additional frame member.

4. A decorative frame member, according to claim 1,wherein the frame member is coupled to a plurality of additional frame members, and forms a frame.

5. A decorative frame member, according to claim 4, wherein the frame is in the shape of at least one of: a polygon, an arc, and a combination of different shapes.

6. A decorative frame member, according to claim 1, wherein the frame member includes at least one of: plastic, aluminum, anodized aluminum, etched aluminum, painted aluminum, and coated aluminum.

7. A decorative frame member, according to claim 1, wherein the front side includes at least one decorative article fastened to the substantially planar region.

8. A decorative frame member, according to claim 1, wherein the decorative tile article includes at least one of: a ceramic tile, a glass tile, and a holographic tile.

9. A decorative frame member, according to claim 1, further comprising an apparatus for mounting at least one framing article to the frame member, and configured and arranged to mount at least one of: glass, a mirror, a picture, a portrait, and a light valance.

10. A decorative frame member, according to claim 1, wherein the back side further includes a second channel substantially parallel to the first channel, and configured and arranged to provide restraint in at least two dimensions.

11. A decorative frame member, according to claim 10, wherein the front side includes at least one decorative article fastened to the substantially planar region.

12. A decorative frame member, according to claim 11, wherein the second channel provides additional support for accommodating at least one heavy decorative article.

13. A decorated frame member, according to claim 1, further comprising an apparatus configured and arranged to couple the first channel to a surface, the apparatus including at least one of: a hinge and a square nut.

14. The decorated frame member of claim 13, wherein the hinge apparatus is configured and arranged to couple to a cabinet.

15. The decorated frame member of claim 14, wherein the frame member is coupled to three other frame members, and forms a door for the cabinet.

16. The frame member of claim 1, wherein the substantially planar region extends uninterrupted between the retaining flanges.

17. The frame member of claim 1, wherein each retaining flange includes a front side surface that remains entirely exposed when the decorative articles are coupled to the front side.

18. The frame member of claim 1, wherein the front side is further adapted to enclose the decorative articles entirely between the retaining flanges.

19. The frame member of claim 1, wherein the planar region is adapted to couple to an inner surface of the at least one decorative tile article that is opposite the front surface, the planar region being adapted to couple to the at least one decorative tile article without breaching a plane defined as including the inner surface of the decorative article.

20. A decorative frame assembly kit comprising:

at least one decorative tile article;

a plurality of extruded frame members comprising a front side and a back side, the front side having a substantially planar region and a retaining flange at each opposing edge of the substantially planar region, wherein the front side is configured and arranged to receive and substantially enclose said at least one decorative tile article with a front surface exposed between the retaining flanges, and a first channel configured and arranged to provide restraint in two dimensions relative to the front side;

fasteners for fastening the plurality of extruded frame members together via the first channel; and means for mounting at least one framing article to at least one of the plurality of extruded frame members.

21. A frame assembly kit, according to claim 20 wherein the fastener for fastening the four extruded frame members together via the first channel includes at least one of: a screw, an L-shaped member, and a fastener member matching the shape of the first channel.

22. A frame assembly kit, according to claim 20 wherein the kit i s configured and arranged to form a plurality of decorative frame shapes.

23. A frame assembly kit, according to claim 20, further comprising a hinge apparatus configured and arranged to couple the first channel to a surface.

24. The kit of claim 20, further including a plurality of decorative articles.

25. The kit of claim 24, wherein the plurality of decorative articles are configured with the frame members to be confined between, and not extending beyond, the retaining flanges.

26. A decorative frame member comprising:

at least one decorative tile article;

a front side having a substantially planar region and a retaining flange at each opposing edge of the substantially planar region, wherein the front side is configured and arranged to accept, couple to and substantially enclose said at least one decorative tile article with a front surface exposed between the retaining flanges;

a back side opposite the front side;

a first channel configured and arranged to provide restraint in two dimensions relative to the front side;

a hinge arrangement configured and arranged to mount to a surface and to the first channel, the hinge arrangement comprising a nut plate configured and arranged to couple to the first channel, and at least one fastener for coupling the hinge arrangement to the surface.

27. A decorative frame member comprising:

a plurality of decorative tile articles;

a front side having a substantially planar region and retaining flanges at opposing edges thereof, each retaining flange having a wall extending perpendicular to the substantially planar region, wherein the walls define outermost edges of the decorative frame member and the front side is configured and arranged to accept, couple to and substantially enclose the decorative articles between the walls, the decorative tile articles not extending beyond the walls;

a back side opposite the front side; and a first channel configured and arranged to provide mounting support and to provide restraint in at least two dimensions relative to the front side.

28. A decorative frame member comprising:

a plurality of decoratively-faced tile articles;

a front side having a substantially planar region and a retaining flange at each opposing edge of the substantially planar region, wherein the front side is configured and arranged to accept, couple to and substantially enclose said articles having respective front surfaces exposed between the retaining flanges;

a back side opposite the front side;

a first channel configured and arranged to provide mounting support and to provide restraint in at least two dimensions relative to the front side; and an article-adhering material disposed between the front surface and the plurality of articles to secure the articles to the front surface.

* * * * *